United States Patent [19]

Bartos

[11] Patent Number: 4,578,020

[45] Date of Patent: Mar. 25, 1986

[54] HYDRAULIC MOTOR

[76] Inventor: Josef Bartos, 8955 N. Shiloh Dr., Chesterland, Ohio 44026

[21] Appl. No.: 782,189

[22] Filed: Oct. 1, 1985

Related U.S. Application Data

[63] Continuation of Ser. No. 574,977, Jan. 30, 1984, abandoned.

[51] Int. Cl.[4] ..... F01C 1/08

[52] U.S. Cl. ..... 418/196

[58] Field of Search ..... 418/16, 20, 196; 91/519, 530

[56] References Cited

U.S. PATENT DOCUMENTS

| | | | |
|---|---|---|---|
| 1,704,704 | 3/1929 | Grant | 418/19 |
| 1,742,215 | 1/1930 | Pigott | 418/21 |
| 1,792,306 | 2/1931 | Jacker | 60/440 |
| 2,293,126 | 8/1942 | Fersing | 418/21 |
| 2,370,526 | 2/1945 | Doran | 60/425 |
| 2,374,588 | 4/1945 | Doran | 60/440 |
| 2,463,950 | 3/1949 | Carroll | 418/21 |
| 2,484,789 | 10/1949 | Hill et al. | 418/30 |
| 2,606,503 | 8/1952 | Shaw | 418/31 |
| 2,691,482 | 10/1954 | Ungar | 418/31 |
| 2,839,889 | 6/1958 | McGill | 418/196 |
| 2,895,422 | 7/1959 | Gold et al. | 418/19 |
| 2,948,228 | 8/1960 | Ahlen | 418/19 |
| 2,964,058 | 12/1960 | Fuente | 91/464 |
| 2,981,287 | 4/1961 | Caslow | 91/464 |
| 3,057,161 | 10/1962 | Henke | 418/196 |
| 3,077,835 | 2/1963 | Wiggermann | 418/32 |
| 3,107,629 | 10/1963 | Wiggermann | 418/19 |
| 3,110,265 | 11/1963 | Miller | 418/21 |
| 3,175,502 | 3/1965 | Kempf et al. | 418/20 |
| 3,225,699 | 12/1965 | Wiggermann | 418/20 |
| 3,375,661 | 4/1968 | Shachter | 418/20 |
| 3,516,764 | 6/1970 | Feroy | 418/19 |
| 3,566,903 | 3/1971 | Honeycutt | 91/464 |
| 3,588,295 | 6/1971 | Burk | 418/21 |
| 3,687,578 | 8/1972 | White et al. | 418/21 |
| 3,762,164 | 10/1973 | Bessette | 60/425 |
| 3,805,526 | 4/1974 | Charron | 60/487 |
| 4,097,204 | 6/1978 | Palmer | 418/19 |

FOREIGN PATENT DOCUMENTS

| | | |
|---|---|---|
| 616719 | 3/1961 | Canada . |
| 1230990 | 9/1960 | France . |
| 708631 | 5/1954 | United Kingdom . |

*Primary Examiner*—Leonard E. Smith
*Assistant Examiner*—Jane E. Obee
*Attorney, Agent, or Firm*—Body, Vickers & Daniels

[57] ABSTRACT

A hydraulic motor having variable speed and torque capabilities is comprised of a housing which provides a primary chamber and a plurality of secondary chambers spaced apart about the primary chamber and opening radially thereinto. A primary gear is supported for rotation in the primary chamber, and a secondary gear is supported for rotation in each of the secondary chambers and in meshing engagement with the primary gear. Each secondary chamber is provided with a pair of ports for connecting the chamber with a source of hydraulic fluid under pressure, whereby fluid flow across the secondary chamber rotates the secondary gear to impart rotation to the primary gear and an output shaft associated therewith. A hydraulic fluid flow control system provides for selectively controlling fluid flow to each of the secondary chambers, thus enabling driving of the primary gear and output shaft in opposite directions and with variable speed and variable torque characteristics in each direction.

5 Claims, 9 Drawing Figures

HYDRAULIC MOTOR

This is a continuation of Ser. No. 574,977, filed Jan. 30, 1984 now abandoned.

BACKGROUND OF THE INVENTION

The present invention relates to the art of hydraulic mechanisms and, more particularly, to a gear type hydraulic mechanism having variable speed and variable torque capabilities.

The present invention finds particular utility as a hydraulic motor and accordingly will be disclosed and described in detail in connection with such use. At the same time, however, it will be appreciated that the invention is applicable to mechanisms other than motors, such as hydraulic pumps and transmission mechanisms for example.

A wide variety of gear type hydraulic motors and pumps have been provided heretofore having variable speed, volume and/or torque capabilities, which capabilities are generally achieved by changing the relative positions of component parts of the mechanism. Efforts have also been made heretofore to provide gear type hydraulic transmissions having variable speed and torque capabilities through the use of a plurality of gear type motors or pumps. In connection with such latter efforts, a plurality of gear type hydraulic motors are longitudinally arranged with respect to the axis of an output shaft and are adapted to be sequentially actuated in response to hydraulic fluid supplied under varying pressure to a hydraulic flow control system for the motors.

Variable hydraulic mechanisms of the foregoing character are structurally complex and expensive with respect to both the construction thereof and to the arrangements by which variable operation is achieved. Generally, such prior mechanisms are not very efficient in operation and are undesirably limited with respect to the magnitude of the variable characteristics which can be realized and/or their versatility with respect to use. The foregoing disadvantages in such prior mechanisms are due in part and in certain instances to the number and/or mass of the gears to be hydraulically driven, and from relative dispositions of the gears which result in the undesirable application or distribution of forces on the component parts during use and operation.

SUMMARY OF THE INVENTION

A variable speed - variable torque hydraulic motor is provided in accordance with the present invention which minimizes and/or overcomes the foregoing and other disadvantages of such mechanisms heretofore provided and which is structurally simple and compact while providing improved versatility and efficiency in connection with its operation and use. More particularly in this respect, a variable speed - variable torque motor in accordance with the present invention is comprised of a primary gear adapted to be driven, selectively, by one or more of a plurality of secondary gears disposed in meshing relationship therewith. The primary gear is disposed in a primary chamber in the motor housing, and each of the secondary gears is disposed in a corresponding secondary chamber in the motor housing. Preferably, the secondary chambers are spaced apart about the periphery of the primary chamber and open radially thereinto, and the primary and secondary gears are of the same axial thickness, thus lending to axial compactness of the motor. Each secondary gear is adapted to be driven by the flow of hydraulic fluid under pressure into the corresponding secondary chamber and across the secondary chamber between ports providing inlet and outlet ports opening thereinto. The flow of hydraulic fluid from a source to each of the secondary chambers is independently controlled, whereby one or more of the secondary gears can be selectively driven to impart driving rotation to the primary gear and an output shaft associated therewith, thus to selectively achieve variable speed - variable torque operation of the output shaft. Furthermore, each of the secondary gears is adapted to be driven by fluid at the same pressure thus optimizing high speed - low torque as well as low speed - high torque operation of the motor.

Individual selectivity with respect to driving of the secondary gears advantageously enables achieving a more balanced fluid distribution internally of the motor and a more balanced distribution of forces with respect to the component parts of the motor, such as by driving diametrically opposed or substantially diametrically opposed secondary gears when more than one secondary gear is actuated. Still further, the driving of the principal gear by one or more secondary gears advantageously improves efficiency as a result of minimizing gear mass with respect to those secondary gears which may be in an idling mode during operation of the mechanism. Efficiency is further enhanced by the fact that the path of the driving fluid through a secondary gear chamber extends about the secondary gear to an extent greater than 180°, whereby more work is realized in connection with fluid force driving the secondary gear.

In accordance with a preferred embodiment, selective and independent control of the secondary gears is achieved by valve assemblies associated with the motor housing and fluid flow passageways within the housing providing inlet and outlet manifolds between which each of the secondary chambers is in flow communication under the control of the corresponding valve assembly. Preferably, each of the secondary chambers is connected across the inlet and outlet manifolds to enable fluid flow between the latter in opposite directions through the secondary chambers, thus to provide for rotating the primary gear and thus the output shaft in opposite directions, and the valve assemblies are selectively operable to control the direction of fluid flow through the corresponding secondary chamber.

Advantageously, control of the motor operation is achieved without the necessity of any relative movement between the gears and the motor housing and/or other component parts within the housing and operatively associated with the gears, and without any relative movement between the primary and secondary gears themselves, other than rotational movement resulting from meshing interengagement therebetween. Accordingly, the gear positions are axially and radially fixed within the motor housing, and there are no internal moving parts other than the rotatable gears, all of which adds to simplicity of construction, reliability in operation, and minimum maintenance.

It is accordingly an outstanding object of the present invention to provide an improved hydraulic motor having variable speed and variable torque capabilities.

Another object is the provision of a hydraulic motor of the foregoing character wherein a primary gear and output shaft associated therewith are adapted to be driven by one or more of a plurality of secondary gears in meshing engagement therewith, each of which secondary gears is adapted to be selectively driven by hydraulic fluid under pressure independently of such drive of the other secondary gears.

A further object is the provision of a hydraulic motor of the foregoing character wherein variable speed and variable torque operation is achieved without requiring relatively movable or displaceable control components operatively associated with the gears within the motor housing, and without requiring any relative displacement between the primary and secondary gears other than the relative rotation thereof resulting from meshing interengagement therebetween.

Still another object is the provision of a hydraulic motor of the foregoing character which enables balanced fluid distribution and a balanced distribution of forces on the component parts thereof during operation.

Yet a further object is the provision of a hydraulic motor of the foregoing character which, for a given size unit, optimizes both high speed - low torque and low speed - high torque operation of the motor.

Yet another object is the provision of a hydraulic motor of the foregoing character in which the selective control of fluid flow relative to the secondary gear chambers is achieved through corresponding valves and hydraulic fluid flow passageways associated with the motor housing.

Still another object is the provision of a hydraulic motor of the foregoing character wherein the valve units and fluid flow passageways are selectively controllable to achieve variable speed, variable torque operation of the motor in opposite directions with respect to rotation of the output shaft.

Still a further object is the provision of a hydraulic motor of the foregoing character which is structurally simple and compact, reliable and efficient in operation, and comprised of structurally interrelated parts which promote minimizing of down time and maintenance costs.

BRIEF DESCRIPTION OF THE DRAWINGS

The foregoing objects, and others, will in part be obvious and in part pointed out more fully hereinafter in conjunction with the written description of a preferred embodiment illustrated in the accompanying drawings in which.

DESCRIPTION OF A PREFERRED EMBODIMENT

Figure 2:
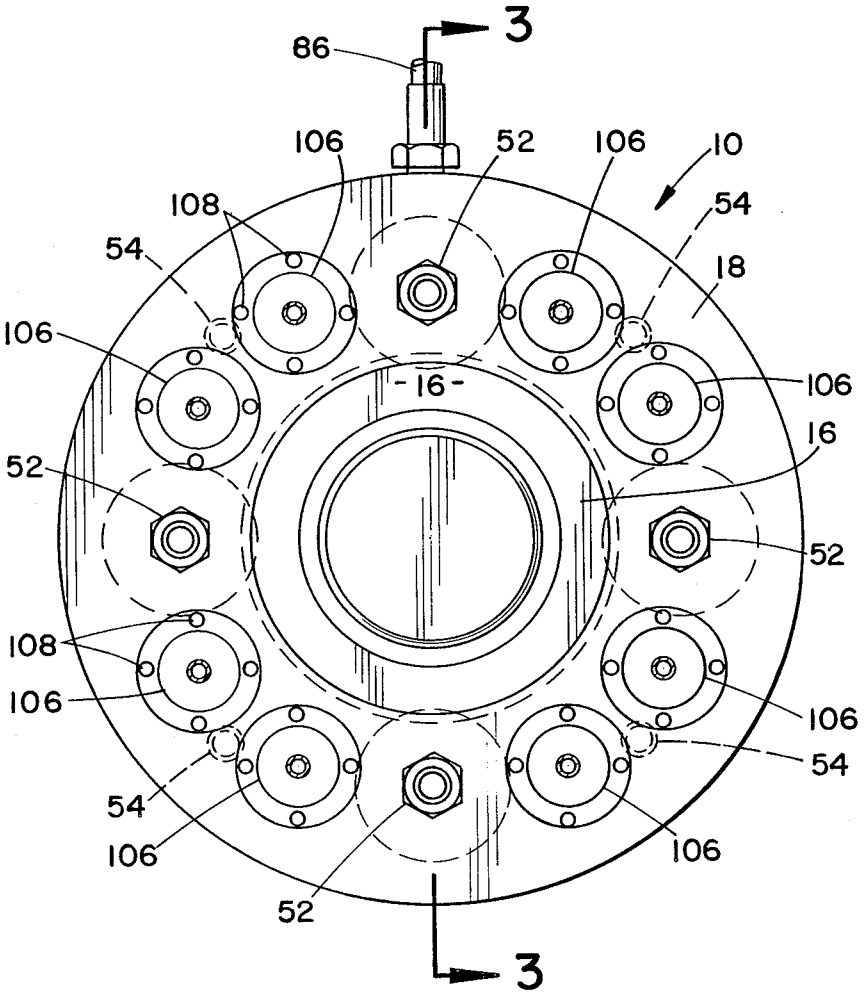
FIG. 2 is an end elevation view of the motor looking in the direction from right to left in FIG. 1.
Figure 1:
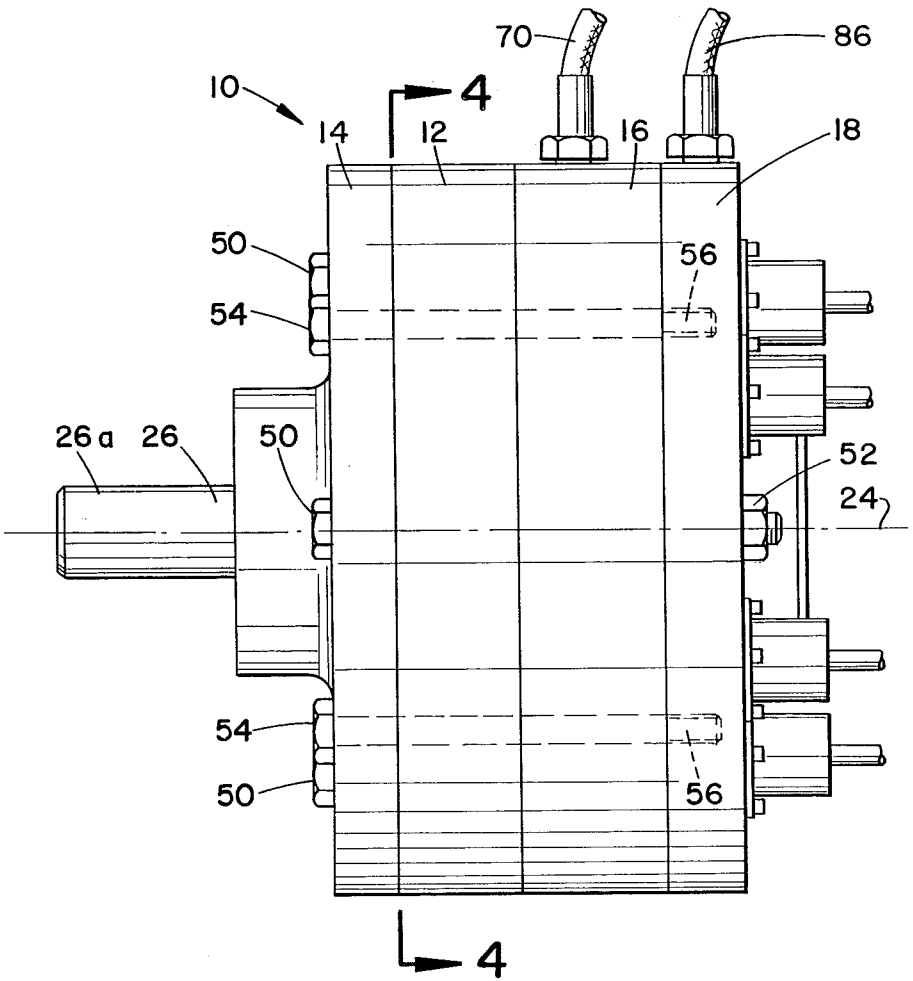
FIG. 1 is a side elevation view of a hydraulic motor in accordance with the present invention.
Figure 4:
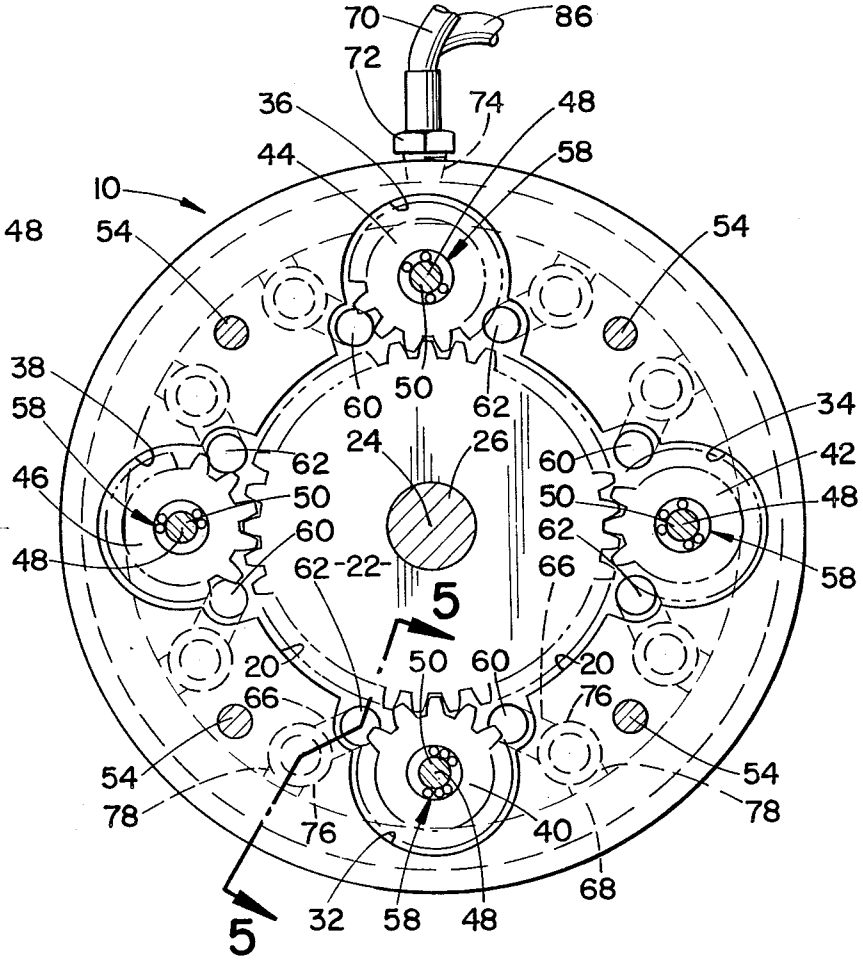
FIG. 4 is a sectional elevation view of the motor taken along line 4—4 in FIG. 1.
Figure 3:
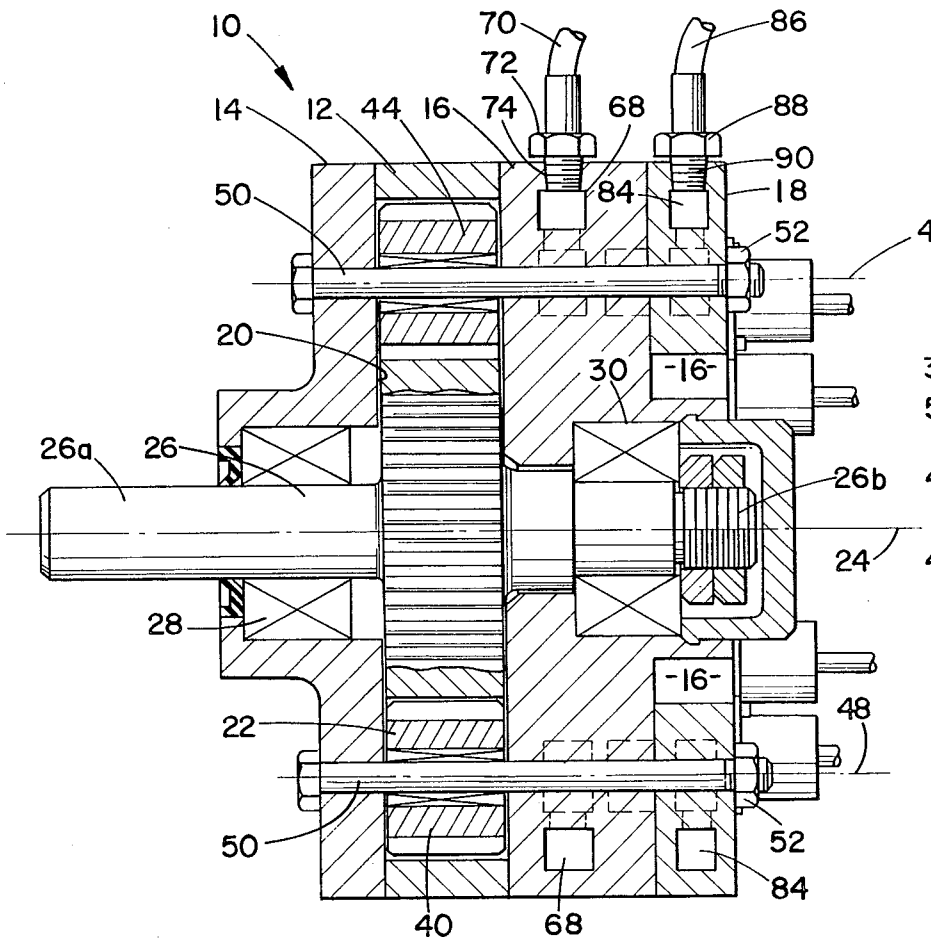
FIG. 3 is a sectional elevation view of the motor taken along line 3—3 in FIG. 2.

Referring now in greater detail to the drawings wherein the showings are for the purpose of illustrating a preferred embodiment of the invention only, and not for the purpose of limiting the invention, FIGS. 1–4 illustrate a hydraulic motor 10 comprised of a housing defined by intermediate housing member 12, end members 14 and 16 on axially opposite sides of member 12, and an annular member 18 axially outwardly adjacent end member 16. As best seen in FIGS. 3 and 4, intermediate member 12 of the housing is an annular component having arcuate inner peripheral portions which provide a primary gear chamber 20 together with the planar axially inner sides of housing members 14 and 16. A primary gear 22 having a toothed outer periphery is supported in chamber 20 for rotation about an axis 24 by means of a shaft 26. More particularly in this respect, shaft 26 has axially opposite ends 26*a* and 26*b* extending through openings therefor in housing members 14 and 16, respectively, and bearing units 28 and 30 are interposed between housing members 14 and 16 and the corresponding portion of shaft 26 to support the latter and thus gear 22 for rotation about axis 24. While shaft 26 is illustrated as being integral with primary gear 22, it will be appreciated that the shaft and primary gear may be separate components keyed or otherwise interengaged for rotation with one another. Shaft 26 is an output shaft for the motor and, in the embodiment illustrated, end 26*a* of the shaft extends axially outwardly from housing member 14 for this purpose.

Figure 8:
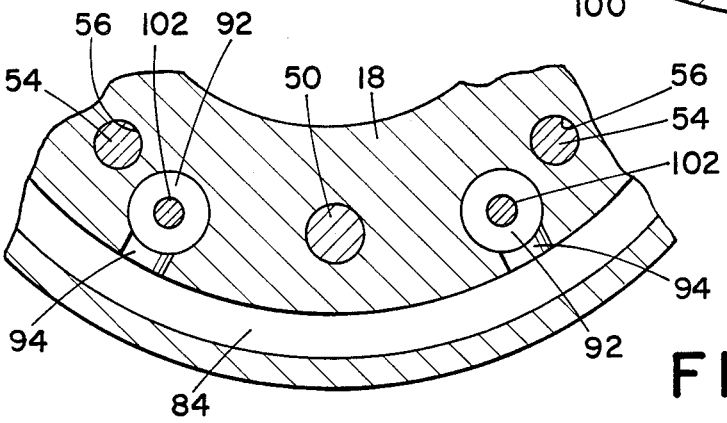
FIG. 8 is a cross-sectional view taken along line 8—8 in FIG. 5: and, FIG. 9 is a schematic illustration of the motor and the fluid flow control arrangement therefor.

Intermediate housing member 12 is further provided about the inner periphery thereof with a plurality of radially outwardly extending recesses which, together with the planar inner sides of housing members 14 and 16 provide secondary gear chambers 32, 34, 36 and 38 equally spaced apart about axis 24 and opening radially inwardly into primary gear chamber 20. Secondary gears 40, 42, 44 and 46 are respectively received in chambers 32, 34, 36 and 38, and each of the secondary gears has a toothed outer periphery in meshing engagement with the teeth of primary gear 22. Further, each of the secondary gears is supported in the corresponding chamber for rotation about a corresponding axis 38 which is parallel to axis 24. In the embodiment illustrated, such rotatable support of the secondary gears is achieved by means of tie rods 50 which extend through openings therefor in the secondary gears and in housing members 14, 16 and 18 and which tie rods have headed ends engaging against the outer side of housing member 14. The opposite ends of tie rods 50 are threaded to receive nuts 52, whereby it will be appreciated that the housing components are maintained in axially engaged relationship by means of tie rods 50 and nuts 52. Additional tie rods 54 extend through housing components 12, 14 and 16 and, as will be appreciated from FIGS. 1 and 8, tie rods 54 have headed ends engaging against the outer side of housing member 14 and threaded opposite ends interengaging with corresponding threaded recesses 56 in housing member 18. Preferably, each of the secondary gears is supported for rotation about the corresponding tie rod 50 by means of needle bearing assemblies 58 interposed therebetween.

Secondary gear chambers 32, 34, 36 and 38 are each provided with pairs of ports 60 and 62 opening axially into the corresponding secondary chamber from housing member 16 and which ports provide for the flow of hydraulic fluid across the corresponding secondary chamber, as set forth more fully hereinafter. Each of the secondary gears is in meshing engagement with primary gear 22 along a radial line through axis 24 and axis 48 of the corresponding secondary gear, and ports 60 and 62 open into the corresponding secondary chamber on circumferentially opposite sides of the corresponding radial line. In operation, one of the ports 60 and 62 provides an inlet port for the flow of hydraulic fluid under pressure into the corresponding secondary chamber and the other port provides an outlet port for the hydraulic fluid. The flow of hydraulic fluid under pressure from the inlet port to the outlet port follows a path radially outwardly about the corresponding secondary chamber, whereby it will be appreciated that such fluid flow drives the secondary gear which in turn drives primary gear 22 and thus the output shaft of the motor.

Further in accordance with the present invention, the flow of hydraulic fluid to each of the secondary chambers is adapted to be selectively and independently controlled so as to enable one or more of the secondary gears to be driven at a given time and to provide selectivity with respect to the secondary gear or gears which are driven. Further, it is preferred to provide for either of the ports 60 and 62 of each of the secondary chambers to be an inlet port for fluid flow, thus enabling rotation of the secondary gears in opposite directions about their axes to provide for rotating primary gear 22 and thus the output shaft of the motor in opposite directions. In the present embodiment, these capabilities are achieved by the hydraulic circuitry and flow control arrangement illustrated in FIGS. 4–8. The fluid flow circuitry and flow control with respect to each of the secondary chambers is identical, whereby it will be appreciated that the following description of the hydraulic circuit and control arrangement associated with port 62 of secondary chamber 32 as shown in detail in FIGS. 5–8 is applicable to the hydraulic circuit and flow control arrangement for port 60 of secondary chamber 32 and for the ports 60 and 62 of secondary chambers 34, 36 and 38.

Figure 5:
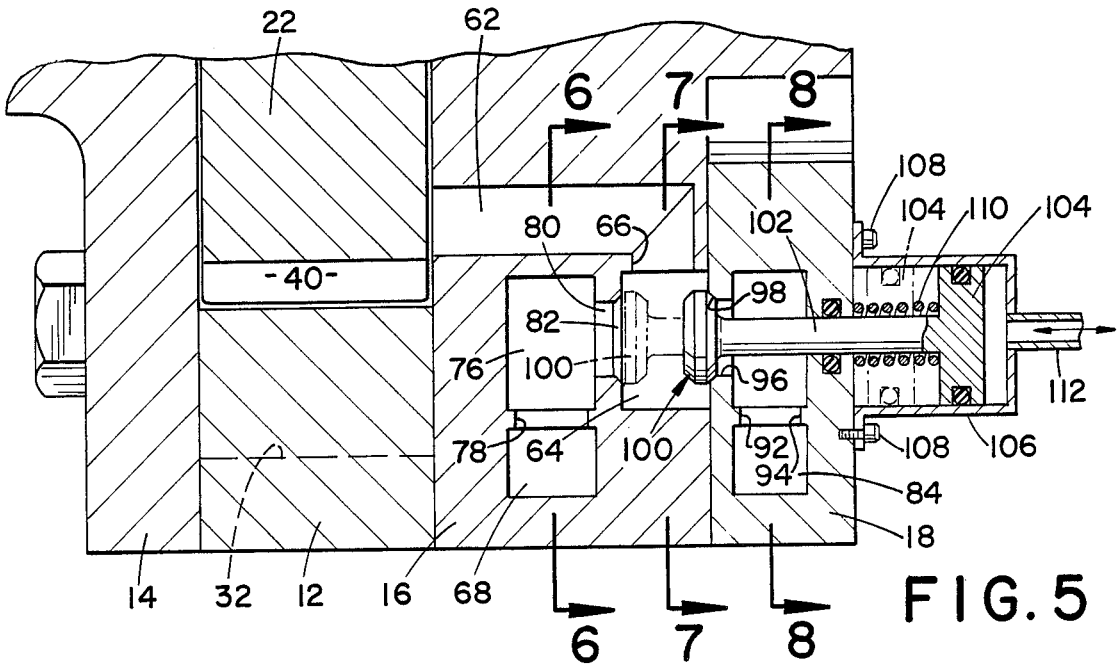
FIG. 5 is a cross-sectional view showing the fluid flow control arrangement for one of the secondary gear chambers as seen along line 5—5 in FIG. 4.
Figure 6:
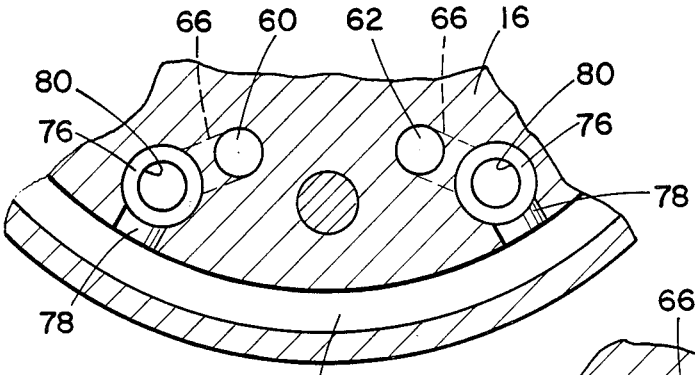
FIG. 6 is a cross-sectional view taken along line 6—6 in FIG. 5.
Figure 7:
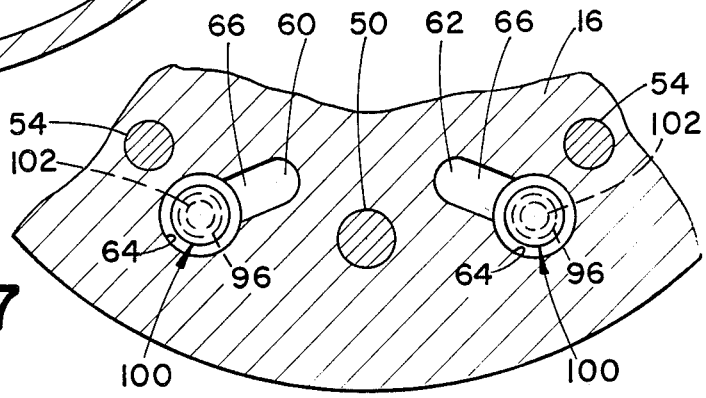
FIG. 7 is a cross-sectional view taken along line 7—7 in FIG. 5.

Referring now in particular to FIGS. 4–8, port 62 extends axially inwardly of housing member 16 and is in flow communication at its inner end with a valve chamber 64 by means of a generally radially extending passage or opening 66. As best seen in FIGS. 3–5, housing member 16 is further provided with a circumferentially continuous hydraulic fluid inlet manifold 68 which, as will be described hereinafter, is connectable to a source of hydraulic fluid under pressure by means of a line 70, a suitable coupling 72 and passageway 74 in housing member 16. Manifold 68 is in flow communication with a chamber 76 by means of a radially connecting passage 78, and chamber 76 is coaxial with valve chamber 64 and in flow communication therewith by means of a passageway 80 having a valve seat 82 on the side thereof facing valve chamber 64. Housing member 18 is provided with a circumferentially continuous hydraulic fluid outlet manifold 84 which, as seen in FIGS. 3 and 4, is adapted to be connected to a hydraulic fluid line 86 by means of a coupling 88 and passageway 90 extending into housing member 18. Manifold 84 is in flow communication with a chamber 92 by means of a radial passageway or opening 94 therebetween, and chamber 92 is coaxial with valve chamber 64 and is adapted to be in flow communication therewith by means of a passageway 96 therebetween and which is provided with a valve seat 98 on the side thereof facing valve chamber 64.

A valve element 100 is disposed in valve chamber 64 on the inner end of a valve stem 102 extending axially outwardly of housing member 18 through a sealed opening therefor in the housing member. The axially outer end of valve stem 102 is provided with a piston 104 which is reciprocable in cylinder member 106 secured to the axially outer side of housing member 18, such as by bolts 108. Valve element 100 is axially reciprocable between first and second positions, respectively shown by the solid and broken line positions of the valve element in FIG. 5, and in the first and second positions the valve element respectively engages seat 98 and seat 82. Accordingly, it will be appreciated that the axially opposite sides of the valve element are beveled for sealing engagement with the corresponding valve seat. In the embodiment illustrated, valve element 100 is biased to the first position by means of a coil spring 110 extending about valve stem 102 and interposed between housing member 18 and piston 104. Displacement of valve element 100 from the first position to the second position is achieved by introducing hydraulic fluid under pressure into cylinder 106 behind piston 104 through a flow line 112. As will be described more fully hereinafter, flow line 112 is connected to a source of low pressure hydraulic fluid through a flow control component, whereby such displacement of valve element 100 is selective.

Figure 9:
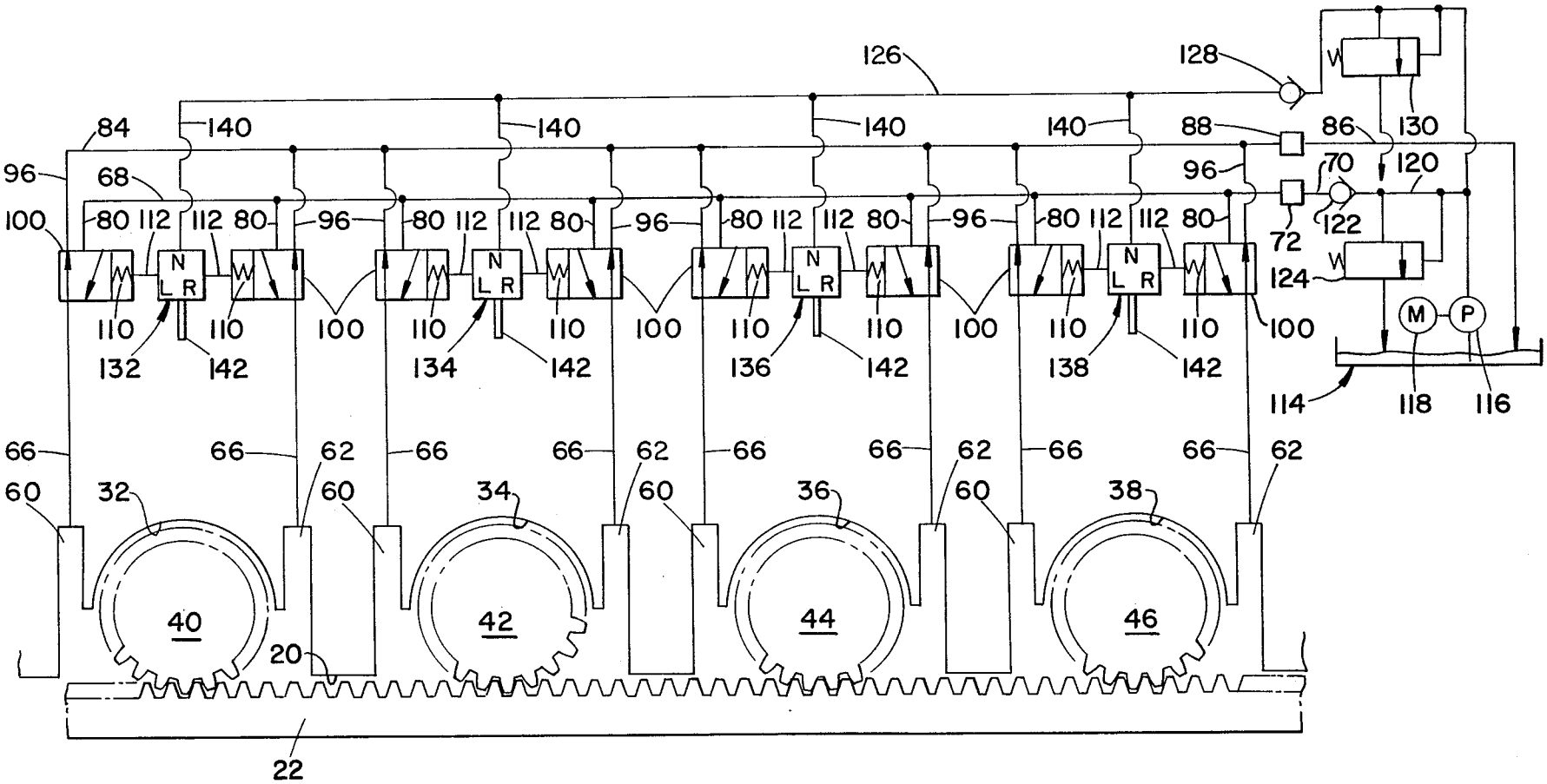

FIG. 9 schematically illustrates the hydraulic motor described hereinabove and schematically shows the hydraulic circuit flow control valve associated with each of the ports of the secondary gear chambers in the manner described hereinabove. These component parts are accordingly designated by numerals corresponding to those appearing in FIGS. 1–8. Additionally, FIG. 9 includes a schematic illustration of a hydraulic fluid supply and return system for the motor, and control components by which low pressure hydraulic fluid is controlled in connection with the displacement of valve elements 100 from the first to the second position thereof. More particularly in this respect, hydraulic fluid from a source 114 is adapted to be delivered under a given constant pressure to inlet manifold 68 by means of a pump 116 driven by a suitable motor 118 and the outlet side of which pump is connected to supply line 70 through a line 120. A check valve 122 prevents reverse flow of fluid from manifold 68 to source 114, and an overload pressure relief valve 124 is operable in a well known manner to open line 120 for flow of fluid back to source 114 when the fluid pressure in manifold 68 is at the predetermined level. Outlet manifold 84 and flow line 86 provide for fluid circulated through the hydraulic motor to be returned to source 114. Pump 116 also delivers hydraulic fluid to a line 126 at a pressure below that of the fluid pressure in manifold 68. Line 126 is provided with a one-way check valve 128 to prevent reverse flow through the line, and a fluid pressure relief valve 130 is operable to return hydraulic fluid to source 114 when the pressure in line 126 is at the desired level. Line 126 is adapted to supply control fluid for displacing valve elements 100 from the first to the second position thereof as described hereinabove and, for the latter purpose, the two valve elements associated with each of the secondary gear chambers 32, 34, 36 and 38 are provided with a common three-position directional flow controller 132, 134, 136 and 138, respectively. Each of the latter flow controllers is connected to flow lines 112 associated with the corresponding pair of valve elements 100 and has an input line 140 connected to supply line 126. Further, each of the directional flow control devices has an operating lever 142 by which the device is adapted to be selectively moved between right, left and neutral positions respectively designated by the capital letters R, L and N in FIG. 9. As will become apparent hereinafter, the latter positions of the directional flow control devices provide for primary gear 22 to be respectively driven to the right or left as viewed in FIG. 9, or to remain in a neutral undriven position. The right and left hand directions as viewed in FIG. 9 respectively translate into clockwise and counterclockwise rotation of primary gear 22 in FIG. 4 of the drawing.

In FIG. 9, operating levers 142 of the directional flow control devices are in the neutral positions thereof, and in the neutral positions the directional flow control devices provide for fluid from lines 126 and 140 to flow through each of the corresponding pair of lines 112 to displace the corresponding valve element 100 to the second position thereof against the bias of spring 110, as illustrated by the broken line position of valve element 100 in FIG. 5. Accordingly, each of the valve elements closes the corresponding flow path from high pressure inlet manifold 68 to the corresponding secondary gear chamber. At the same time, each valve in the second position thereof opens the flow path between the corresponding secondary chamber and outlet manifold 84 through the corresponding one of the chamber ports 60 and 62 and passageways 66 and 96. Accordingly, in the neutral position of the directional flow control devices there is no flow of high pressure fluid through the hydraulic motor, whereby the latter is in a standby condition.

Each of the directional flow control devices in the right or R position of the control lever operates to close line 112 of the valve element 100 associated with port 62 of the corresponding secondary chamber to flow from supply lines 126 and 140, whereby the latter valve element 100 is biased by spring 110 to the right in FIG. 9 and thus to the first or solid line position of the valve elements shown in FIG. 5. At the same time, such positioning of the control lever 142 maintains flow communication from supply lines 126 and 140 through lines 112 of the valve elements 100 associated with ports 60 of the secondary gear chambers, whereby the latter valve elements 100 remain in the second position thereof shown in FIG. 9 and by broken lines in FIG. 5. With the directional flow controller so positioned, it will be appreciated that hydraulic fluid under high pressure flows from inlet manifold 68 through passageways 80 to the corresponding valve elements 100 associated with secondary gear chamber ports 62 and thence across the valve elements to the latter ports through passageways 66. Hydraulic fluid under pressure flowing into the secondary gear chambers through ports 62 flows counterclockwise through the secondary chambers about the inner periphery of the latter to ports 60 thereof, whereby the corresponding secondary gear is driven counterclockwise to drive primary gear 22 to the right or clockwise as respectively viewed in FIGS. 9 and 4. Hydraulic fluid under pressure flowing through the secondary gear chambers in this mode of operation flows through ports 60 to the corresponding valve elements 100 through passageways 66 and thence across the valve element and to outlet manifold 84 through passageways 96.

When the control levers 142 of the directional flow control devices are displaced to the left or L positions thereof, the positions of the valves 100 associated with secondary chamber ports 60 and 62 are reversed from that just described. In this respect, the flow of control fluid through lines 112 of the valve elements 100 associated with secondary chamber ports 60 is blocked, whereby the latter valve elements are biased by springs 110 to the left in FIG. 9 and thus to the first positions thereof shown by the solid line positions of valve element 100 in FIG. 5, and control fluid from lines 126 and 140 flows through lines 112 of the valve elements associated with secondary chamber ports 62, whereby the latter valve elements are displaced back to the second positions thereof shown in FIG. 9 and by the broken line position of valve element 100 in FIG. 5. With the control levers so positioned, hydraulic fluid under pressure from inlet manifold 68 flows through lines 80 of the valve elements associated with secondary chamber ports 60 and thence across the valve elements to the latter ports through passageways 66. Hydraulic fluid under pressure entering the secondary chambers through ports 60 flows clockwise about the outer periphery of the secondary chambers to ports 62 thereof, whereby the secondary gears are driven clockwise to displace primary gear 22 to the left or counterclockwise as respectively viewed in FIGS. 9 and 4. Fluid flowing through the secondary gear chambers in the latter direction flows through chamber ports 62 and the corresponding passageway 66 across the corresponding valve element 100 and to the outlet manifold 84 through passageway 96.

It will be appreciated from the foregoing description that any one or more of the secondary gears 40, 42, 44 and 46 can be selectively actuated to drive primary gear 22. For example, if control lever 142 of the directional flow control device 132 associated with secondary gear 40 is moved to the right or R position and the control levers of the remaining flow control devices are left in the neutral or N positions thereof, secondary gear 40 alone will be driven in the manner described hereinabove to drive primary gear 22 and thus the output shaft of the motor in the clockwise direction. During such operation of the motor, it will be noted that both ports 60 and 62 of each of the secondary gear chambers 34, 36 and 38 provides an open flow path to return manifold 84, whereby leakage of hydraulic fluid along a path between primary gear chamber 20 and primary gear 22 can flow to the outlet manifold. It will be appreciated that the flow of hydraulic fluid under pressure to drive secondary gear 40 in the foregoing manner provides for high speed - low torque rotation of primary gear 22 and thus the output shaft of the motor. Selectively shifting any one of the control levers of the flow control devices associated with secondary gear chambers 34, 36 and 38 to the right or R position thereof then provides for two of the secondary gears to be driven to drive primary gear 22, such additional secondary gear drive providing for a lower speed - higher torque operating characteristic for the output shaft of the motor. It will be appreciated of course that the third and fourth secondary gears can be selectively and independently actuated in the foregoing manner, and that the four secondary gears can likewise be selectively and independently actuated to achieve rotation of the drive shaft in the opposite direction. Advantageously, with respect to the embodiment illustrated, the selectivity with respect to driving of the secondary gears enables diametrically opposed secondary gears to be driven when it is desired to drive the primary gear using two of the secondary gears. Such advantage comes from the fact that the diametrically opposed relationship of the driving secondary gears promotes a more balanced distribution of hydraulic fluid flow relative to the interior of the motor and a more balanced distribution of forces between the secondary gears and primary gear and thus between the motor shaft and the bearing units supporting the latter for rotation.

While considerable emphasis has been placed herein on the embodiment illustrated and described, it will be appreciated that other embodiments as well as modifications of the disclosed embodiment can be made without departing from the principles of the present invention. In particular, while the embodiment disclosed herein includes four secondary gears and corresponding chambers, it will be appreciated that any number of secondary gears and chambers can be provided and utilized as described herein. Further, it will be appreciated that arrangements other than that described herein can be devised for controlling fluid flow to and from the secondary chambers, and that flow control for the purpose set forth herein can be achieved by hydraulic circuitry and control components which are not mounted on or provided in component parts of the motor housing. Further, with regard to the disclosed embodiment, it will be appreciated that the hydraulically actuated flow control valves could be electrically actuated such as through the use of solenoids, or pneumatically actuated and, in connection with the latter or the hydraulic actuation described herein, displacement of the valves in their opposite directions could be achieved by fluid flow acting on opposite sides of the valve piston rather than through the use of biasing springs for movement in one of the two directions.

Still further, while it is preferred to provide hydraulic circuitry and flow control devices enabling operation of the motor in opposite directions, it will be appreciated that corresponding ones of the ports of the secondary chambers could always be outlet ports communicating with a return line of the hydraulic supply system, whereby it would only be necessary to control the flow of fluid through the other ports of the secondary chamber to achieve the selective actuation of the secondary gears and thus the variable speed - variable torque characteristics desired. Still further, in the latter flow control arrangement it would be possible to achieve operation of the motor in opposite directions by reversing the high pressure inlet and return line connections with respect to the secondary chambers. The foregoing and other hydraulic fluid circuits and flow control arrangements as well as the foregoing and other modifications of the flow control circuitry illustrated and described herein will be apparent to those skilled in the art upon reading the foregoing description of the embodiment disclosed. Moreover, while the invention finds particular utility as a variable speed - variable torque hydraulic motor, it will be appreciated that the output shaft can be driven for the primary gear to drive the secondary gears to enable operation of the motor as a variable pump, and that hydraulic supply systems and flow control arrangements can be devised and employed in connection with the hydraulic motor for the latter to be operable in connection with such circuitry as a variable speed - variable torque hydraulic transmission.

Since many embodiments of the present invention can be made and since many changes can be made in the embodiment herein illustrated and described without departing from the principles of the present invention, it is to be distinctly understood that the foregoing descriptive matter is to be interpreted as illustrative of the invention only and not as a limitation.

Having thus described the invention, it is claimed:

1. A variable hydraulic motor comprising, housing means providing a primary chamber having a first axis and a plurality of secondary chambers opening into said primary chamber, a primary gear in said primary chamber rotatable about said first axis, a secondary gear in each of said secondary chambers rotatable about a corresponding second axis parallel to said first axis, each of said secondary gears being in meshing engagement with said primary gear along a line through said first axis and the corresponding one of said second axes, each of said secondary chambers having a pair of fluid flow ports, the ports of each pair opening into the corresponding secondary chamber on circumferentially opposite sides of the corresponding one of said lines, means providing hydraulic fluid inlet and outlet lines, said pair of ports of each said secondary chamber being connected across said inlet and outlet lines, and means for selectively controlling fluid flow to each port of said pair of ports of each said secondary chamber including valve means for each port of said pair of ports, each said valve means having a first position blocking fluid flow through said inlet line to the corresponding one of said pair of ports and permitting fluid flow through said outlet line from said one port, and a second position permitting fluid flow through said inlet line to said one port and blocking fluid flow through said outlet line from said one port; and valve control means operatively associated with the valve means of each said pair of ports for normally maintaining each said valve means in said first position and for selectively moving one of said valve means from said first position to said second position thereof while maintaining the other valve means in said first position thereof.

2. The hydraulic motor according to claim 1, wherein said secondary chambers are equally spaced apart about said first axis and open radially inwardly into said primary chamber.

3. The hydraulic motor according to claim 1, wherein said secondary chambers are equally spaced apart about said first axis and open radially inwardly into said primary chamber, said housing means including means providing circumferentially continuous fluid inlet and outlet manifolds and fluid flow passageway means for each said secondary chamber and connecting the pair of ports thereof across said inlet and outlet manifolds.

4. The hydraulic motor according to claim 1, wherein said means providing inlet and outlet lines includes a single inlet and a single outlet manifold means in said housing and fluid flow passageway means for each said secondary chamber, each said passageway means connecting the pair of ports of the corresponding secondary chamber across said inlet and outlet manifold means.

5. The hydraulic motor according to claim 10, wherein said fluid flow passageway means includes first and second flow passageway means for each said secondary chamber and said valve means includes a valve for each said first and second flow passageway means; said first and second flow passageway means respectively connecting the pair of ports of the corresponding secondary chamber for flow through said ports in opposite directions from said inlet manifold means to said outlet manifold means.

* * * * *